US011428196B1

(12) United States Patent
Schreader et al.

(10) Patent No.: US 11,428,196 B1
(45) Date of Patent: Aug. 30, 2022

(54) FUEL SYSTEM AND CONTROL STRATEGY LIMITING COMPONENT SEPARATION IN PUSHROD ACTUATION TRAIN

(71) Applicant: Caterpillar Inc., Peoria, IL (US)

(72) Inventors: Kevin J Schreader, East Peoria, IL (US); Victor I Yacoub, Washington, IL (US); Satya Naga Deepak Pillarisetti, Tremont, IL (US); Bradley D. Ferguson, Dunlap, IL (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 17/538,054

(22) Filed: Nov. 30, 2021

(51) Int. Cl.
*F02M 51/06* (2006.01)
*F02D 41/40* (2006.01)
*F02M 61/04* (2006.01)

(52) U.S. Cl.
CPC ..... *F02M 51/061* (2013.01); *F02D 41/401* (2013.01); *F02M 61/042* (2013.01)

(58) Field of Classification Search
CPC ... F02M 51/061; F02M 61/042; F02D 41/401
See application file for complete search history.

(56) References Cited

U.S. PATENT DOCUMENTS 5,533,672 A 7/1996 Peters
5,538,397 A * 7/1996 Laufer ..... F02M 41/125 417/278
5,964,406 A * 10/1999 Zuo ..... F02M 59/466 137/625.68
6,047,899 A * 4/2000 Graves ..... F02M 57/025 239/96
6,595,189 B2 7/2003 Coldren et al.
6,688,536 B2 * 2/2004 Coldren ..... F02M 59/32 239/91
7,559,314 B2 7/2009 Remmelgas
2008/0092853 A1 4/2008 Harcombe et al.
2013/0186373 A1 * 7/2013 Oppermann ..... F02M 47/027 123/480
2016/0025052 A1 * 1/2016 Yasukawa ..... F02M 51/0625 239/585.1
2016/0097358 A1 * 4/2016 Miyake ..... F02M 51/066 239/585.1

* cited by examiner

*Primary Examiner* — Carl C Staubach
(74) *Attorney, Agent, or Firm* — Brannon Sowers & Cracraft PC

(57) ABSTRACT

A fuel system for an internal combustion engine includes an actuation train having a cam follower, a pushrod, a rocker arm, and a camshaft having a cam lobe rotatable in contact with the cam follower according to an ascending ramp phasing, a peak phasing, and a descending ramp phasing. The fuel system further includes a fuel injector including an electrically actuated spill valve. A fueling control unit is in communication with the spill valve and structured to close the spill valve during the ascending ramp phasing, such that a plunger cavity pressure is increased to oppose a plunger-advancement inertia of the actuation train. Related methodology and control logic is also disclosed.

20 Claims, 4 Drawing Sheets

FUEL SYSTEM AND CONTROL STRATEGY LIMITING COMPONENT SEPARATION IN PUSHROD ACTUATION TRAIN

TECHNICAL FIELD

The present disclosure relates generally to actuating a fuel injector in a fuel system for an engine, and more particularly to operating a spill valve to oppose plunger-advancement inertia of an actuation train.

BACKGROUND

Mechanically actuated fuel injectors are used in a variety of engines that are well-known and widely used throughout the world. In a typical arrangement a fuel injector is equipped with a plunger and tappet. The tappet is configured to be acted upon directly by a rotating camshaft or indirectly by a rocker arm that is pivoted by way of a camshaft, commonly using an intervening pushrod. Mechanical actuation of the plunger in the fuel injector enables a highly reliable and robust strategy for achieving high fuel injection pressures desirable for improved performance, notably with regard to reduction of certain emissions.

To achieve relatively high fuel pressures it is generally necessary to reciprocate the plunger with considerable force. In one common design a spill valve is resident on or otherwise associated with a fuel injector and when open allows the plunger to passively reciprocate, exchanging fuel between a low pressure fuel supply or space, and a plunger cavity without pressurizing the fuel for injection. When it is desirable to increase fuel pressure in anticipation of a fuel injection event the spill valve can be closed to enable the plunger to pressurize the fuel in a plunger cavity within the fuel injector. In some designs the fuel pressure in the fuel injector determines opening and closing timings of the nozzle check by acting upon opening hydraulic surfaces thereof. In other common designs direct control of the nozzle check is used to selectively apply a closing hydraulic pressure to a surface of the nozzle check until such time as it is desirable to initiate fuel injection. When ending fuel injection is desired closing hydraulic pressure is returned to the surface of the nozzle check and it is urged closed.

The relatively high forces used in mechanical actuation of fuel injectors can lead to certain difficulties relative to wear and performance. In some instances, components used to actuate the plunger can have sufficient inertia that they actually come out of contact with one another within an actuation train for the fuel injector in response to fuel pressure changes therein. When the components return into contact force spikes leading to excessive wear or performance degradation can occur. One known mechanical actuation strategy for a fuel injector is set forth in U.S. Pat. No. 6,688,536 to Coldren et al. In Coldren, it appears a plunger is provided that is not mechanically coupled to a tappet and can uncouple from the tappet during an injection event to address problems related to plunger wear and failure. While Coldren et al. may have various applications, there is always room for improvement and/or development of alternative strategies.

SUMMARY

In one aspect, a fuel system for an internal combustion engine includes an actuation train having a cam follower, a pushrod, a rocker arm, a plunger tappet, and a camshaft having a cam lobe forming an ascending ramp, a peak, and a descending ramp, and rotatable in contact with the cam follower according to an ascending ramp phasing, a peak phasing, and a descending ramp phasing. The fuel system further includes a fuel injector having formed therein a plunger cavity and a plurality of nozzle outlets, and defining a low pressure space. The fuel injector includes a plunger coupled to the plunger tappet and movable within the plunger cavity, a nozzle check, and an electrically actuated spill valve adjustable between a closed state where the electrically actuated spill valve blocks the plunger cavity from the low pressure space, and an open state. The fuel system further includes a fueling control unit in control communication with the electrically actuated spill valve and structured to open the electrically actuated spill valve during the ascending ramp phasing of the cam lobe. The fueling control unit is further structured to close the electrically actuated spill valve during the ascending ramp phasing, such that a plunger cavity pressure is increased to oppose a plunger-advancement inertia of the actuation train. The fueling control unit is further structured to open the electrically actuated spill valve to spill the increased plunger cavity pressure to the low pressure space.

In another aspect, a method of operating a fuel system for an internal combustion engine includes rotating a cam lobe in contact with a cam follower to reciprocate a pushrod coupled to a pivotable rocker arm in an actuation train for a fuel injector in the fuel system. The method further includes advancing and retracting a plunger in the fuel injector coupled to the rocker arm to exchange a fuel between a plunger cavity in the fuel injector and a low pressure space. The method further includes closing a spill valve at an earlier timing to block the plunger cavity from the low pressure space, during an ascending ramp phasing of the cam lobe, to increase a plunger cavity pressure in the fuel injector to an injection pressure, and injecting a fuel from the fuel injector at the injection pressure. The method further includes closing the spill valve at a later timing to block the plunger cavity from the low pressure space, during the ascending ramp phasing of the cam lobe, and opposing a plunger-advancement inertia of the actuation train via an increased plunger cavity pressure produced in response to the closing of the spill valve at the later timing. The method still further includes limiting gapping in the actuation train based on the opposing plunger-advancement inertia of the actuation train, and opening the spill valve to spill the increased plunger cavity pressure to the low pressure space.

In still another aspect, a control system for an engine fuel system including a fuel injector having a plunger movable within a plunger cavity, and an actuation train for the plunger having a cam follower, a pushrod, a rocker arm, a plunger tappet, and a camshaft, is provided. The camshaft has a cam lobe forming an ascending ramp, a peak, and a descending ramp, and is rotatable in contact with the cam follower according to a cam phasing including an ascending ramp phasing, a peak phasing, and a descending ramp phasing. The control system includes a fueling control unit having a timing controller structured to receive timing signals from a timing sensor indicative of the cam phasing of the cam lobe, and a valve actuation controller. The valve actuation controller is structured to deenergize a solenoid actuator of a spill valve in the fuel injector to open the spill valve during the ascending ramp phasing, and deenergize a solenoid actuator of an injection control valve in the fuel injector to close the injection control valve during the ascending ramp phasing to end an injection of fuel from the fuel injector. The valve actuation controller is further structured to energize the solenoid actuator of the spill valve to close the spill valve between a first timing occurring during the ascending ramp phasing and a second timing occurring during the descending ramp phasing, and to limit ballistic separation in the actuation train based on an increase to a plunger cavity pressure produced in response to the closing of the spill valve between the first timing and the second timing.

DETAILED DESCRIPTION

Figure 1:
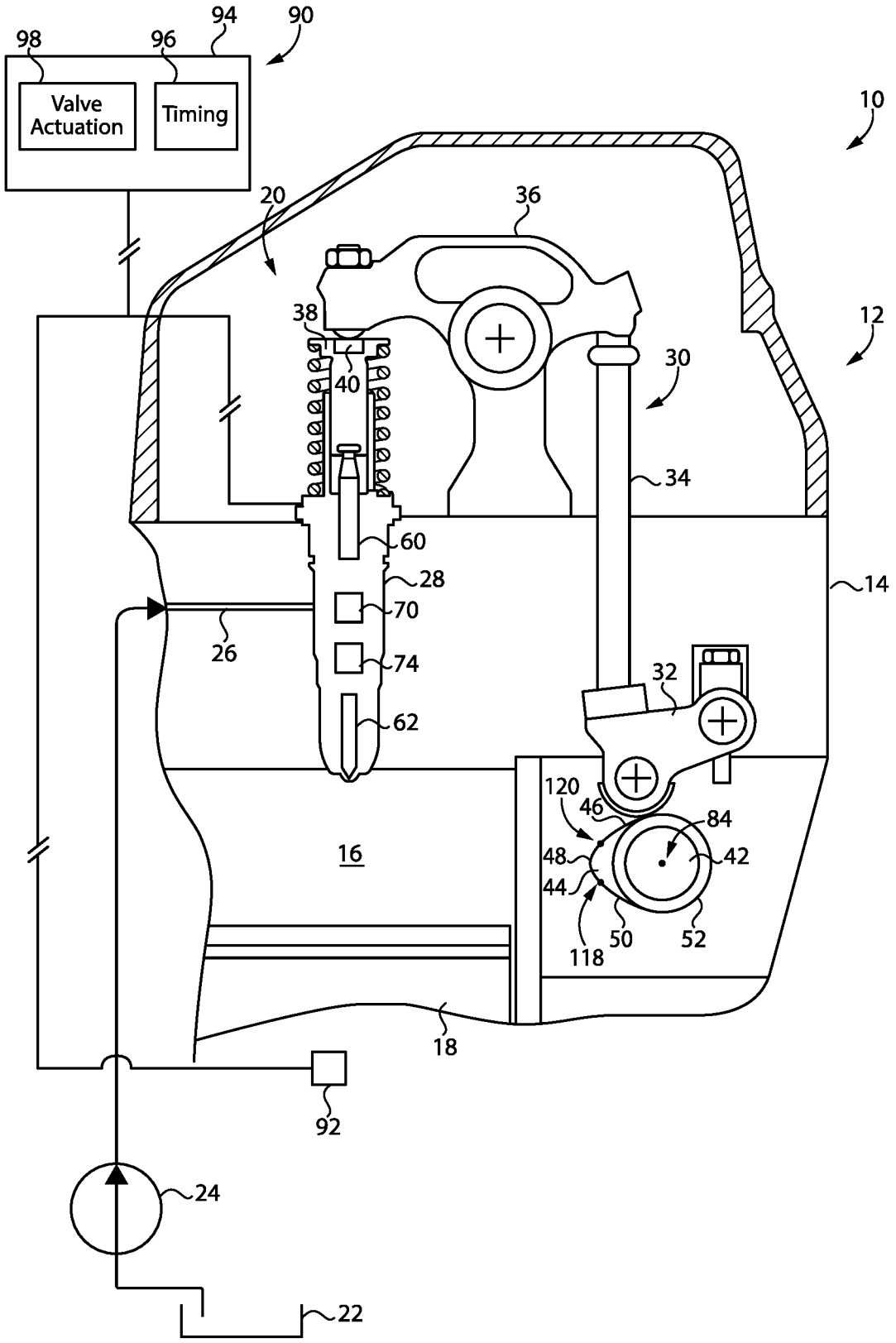
FIG. 1 is a diagrammatic view of an internal combustion engine system, according to one embodiment.

Referring to FIG. 1, there is shown an internal combustion engine system 10, according to one embodiment. Engine system 10 includes an internal combustion engine 12, including an engine housing 14. Engine housing 14 has a cylinder 16 formed therein and a piston 18 movable within cylinder 16 between a top dead center position and a bottom dead center position. Engine 12 can include any number of cylinders in any suitable arrangement, such as an in-line pattern, a V-pattern, or still another. Engine 12 may include a compression-ignition engine operable on a suitable compression-ignition liquid fuel such as a diesel distillate fuel, a biodiesel fuel, a liquid fuel including a cetane enhancer, or various blends. In still other embodiments engine 12 could be a dual fuel engine. Engine 12 will typically be operated in a conventional four-stroke engine cycle, however, the present disclosure is also not limited in this regard. Those skilled in the art will appreciate that engine 12 may be equipped with various apparatus not pictured in FIG. 1 including but not limited to engine valves, a turbocharger, an intake air system, and an exhaust system. Piston 18 will typically be movable in cylinder 16 in a compression stroke to increase a pressure of fluids in cylinder 16 to an autoignition threshold. Engine system 10 may be implemented in applications ranging from vehicle propulsion to operation of a pump or compressor, for example, or for operating an electrical generator.

Engine system 10 further includes a fuel system 20. Fuel system 20 may include a fuel supply 22 or fuel tank, and a low pressure transfer pump 24 operable to transfer a liquid fuel from fuel supply 22 to engine housing 14. Liquid fuel from low pressure transfer pump 24 can be conveyed through a fuel passage 26 formed in engine housing 14. Fuel system 20 also includes a fuel injector 28 positioned so as to extend partially into cylinder 16. Fuel injector 28 may be one of a plurality of fuel injectors in fuel system 20 that are interchangeable for service amongst the plurality of cylinders in engine 12. Fuel system 20 further includes an actuation train 30 for actuating fuel injector 28, and including a cam follower 32, a pushrod 34, a rocker arm 36, a plunger tappet 38, and a camshaft 42. A socket piece 40 may be positioned between rocker arm 36 and tappet 38.

Camshaft 42 includes a cam lobe 44 forming an ascending ramp 46, a peak 48, and a descending ramp 50. Camshaft 42 and/or cam lobe 44 may also include a base circle surface 52. In a practical implementation strategy cam lobe 44 may be one of a plurality of cam lobes of camshaft 42 each forming part of one of a plurality of actuation trains 30 for a plurality of fuel injectors 28 in fuel system 20. Camshaft 42 is rotatable about a camshaft axis 84, typically at one-half engine speed. Cam lobe 44 is rotatable in contact with cam follower 32 according to an ascending ramp phasing, a peak phasing, and a descending ramp phasing. It will be appreciated that the ascending ramp, peak, and descending ramp phasings represent angular ranges circumferentially around camshaft axis 84 where cam follower 32 is in contact with the respective ascending ramp 46, peak 48, and descending ramp 50, the significance of which will be further apparent from the following description.

Actuation train 30 defines a plurality of gapping locations. The gapping locations are locations in actuation train 30 where components are not mechanically and directly attached to one another, but are in contact with one another. A first gapping location may be defined between rocker arm 36 and socket 40, a second gapping location may be defined between socket 40 and tappet 38, a third gapping location may be defined between pushrod 34 and cam follower 32, and a fourth gapping location may be defined between cam follower 32 and cam lobe 44. Pushrod 34 may be a relatively massive component of actuation train 30 and, together with other components of actuation train 30, can have an inertia during reciprocation sufficient to cause components in actuation train 30, and potentially in an associated geartrain, to separate at gapping locations, absent the mitigation strategies contemplated herein. As suggested above, gapping separation between touching components in actuation train 30 can cause undesired wear and/or performance problems. As will be further apparent from the following description, fuel system 20 may be uniquely configured to limit or inhibit entirely gapping separation between components in actuation train 30.

Figure 2:
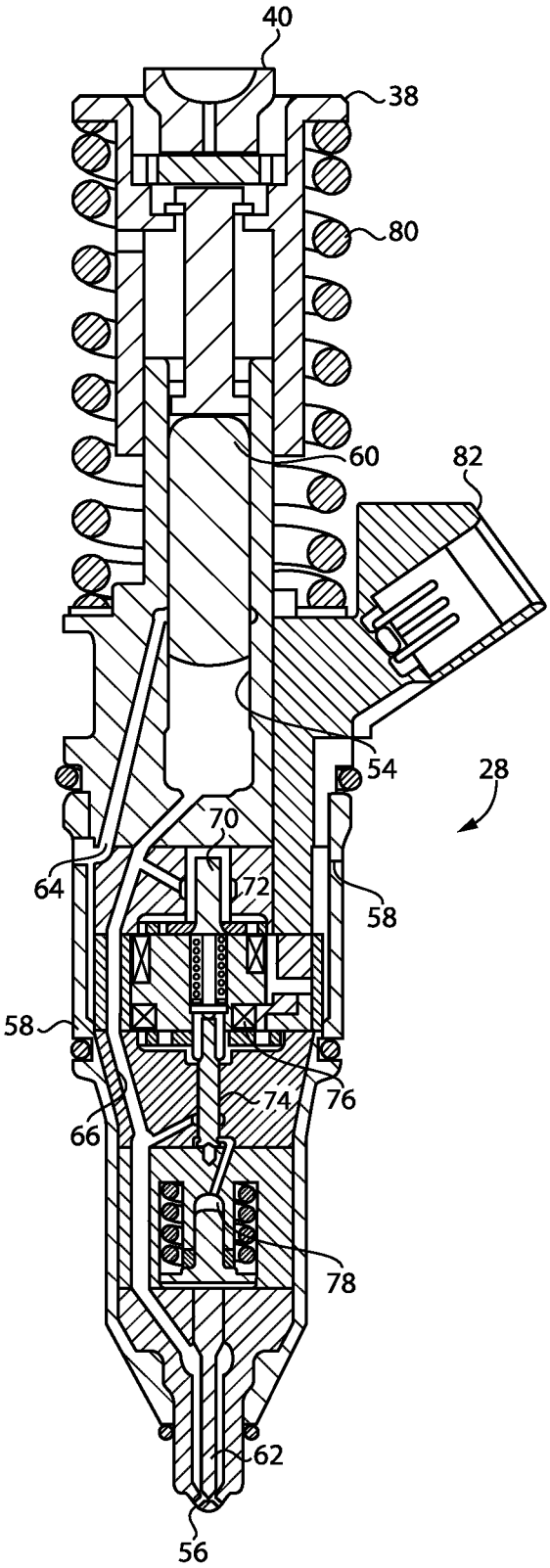
FIG. 2 is a sectioned side diagrammatic view of a fuel injector suitable for use in the internal combustion engine of FIG. 1.

Referring also now to FIG. 2, there are shown features of fuel injector 28 in further detail. Fuel injector 28 has formed therein a plunger cavity 54 and a plurality of nozzle outlets 56. Fuel injector 28 includes a plunger 60 coupled to plunger tappet 38 and movable within plunger cavity 54 between an advanced position and a retracted position to draw fuel into plunger cavity 54 and expel fuel from plunger cavity 54. Fuel injector 28 further includes a nozzle check 62 which may be configured as a directly controlled needle check. Fuel injector 28 also includes a fuel passage that supplies fuel around plunger 60 for sealing and lubrication. A nozzle supply passage 66 extends between plunger cavity 54 and nozzle outlets 56. Fuel injector 28 also includes an electrically actuated injection control valve 74 and a solenoid electrical actuator 76 for injection control valve 74. A check control chamber is shown at 78. Injection control valve 74 can be adjusted between an open state at which check control chamber 78 is exposed to low pressure and actuating fluid therein, typically but not necessarily fuel, can be expelled out of fuel injector 28, and a closed state at which check control chamber 78 is exposed to a pressure of nozzle supply passage 66. The construction and operation of injection control valve 74 is generally known in the art. A tappet return spring is shown at 80 and opposes a downward actuating force applied by rocker arm 36 to plunger 60. Fuel injector 28 also includes an electrical connector 82 structured to electrically connect with electronic control apparatus further discussed herein.

Fuel injector 28 also includes an electrically actuated spill valve 70 and a solenoid electrical actuator 72 for spill valve 70. Spill valve 70 is adjustable between a closed state where spill valve 70 blocks plunger cavity 54 from a low pressure space 58, and an open state where spill valve 70 does not block plunger cavity 54 from low pressure space 58. Low pressure space 58 is defined by fuel injector 28 and can include passages, clearances, or cavities within fuel injector 28 as well as including or being connected to a space outside fuel injector 28, including fuel passage 26. When spill valve 70 is in a closed state and plunger cavity 54 is blocked from low pressure space 58 plunger 60 can advance through plunger cavity 54 to increase a pressure of fuel in fuel injector 28. When spill valve 70 is in an open state plunger 60 passively reciprocates to exchange fuel between plunger cavity 54 and low pressure space 58. In an implementation low pressure space 58 is a fuel feed space formed in engine housing 14 and extending around fuel injector 28 and being filled with low pressure fuel.

Fuel system 20 further includes a control system 90. Control system 90 may include a fueling control unit 94 and a timing sensor 92. Timing sensor 92 may be coupled with a crankshaft, with camshaft 42, or with another rotatable component such as a gear having a position, an orientation or a state that is indicative of crank angle or cam angle directly or indirectly. Timing sensor 92 produces timing signals interpreted by fueling control unit 94 for purposes of controlling fuel injector 28 as further discussed herein. In one implementation, fueling control unit 94 includes a timing controller 96 that receives timing signals from timing sensor 92. Timing controller 96 may be any combination of hardware including circuitry, firmware, or software resident on fueling control unit 94 that enables fueling control unit 94 to act upon certain events relating to engine timing. Fueling control unit 94 may also include a valve actuation controller 98, also including any combination of hardware including circuitry, firmware, or software resident on fueling control unit 94 that enables fueling control unit 94 to output electrical current control commands to fuel injector 28 to energize and deenergize solenoid electrical actuator 72 and solenoid electrical actuator 76, to control spill valve 70 and injection control valve 74 as further discussed herein. Fueling control unit 94 will typically include a computer readable memory storing computer executable control instructions which can be executed by one or more data processors of fueling control unit 94 to perform the functions of timing controller 96 and valve actuation controller 98, as well as other fuel system control functions. Timing controller 96 and valve actuation controller 98 may be subroutines of the same algorithm in some embodiments. The computer readable memory can be any suitable memory such as RAM, ROM, SDRAM, DRAM, FLASH, et cetera. The data processor can include any suitable programmable logic controller such as a microprocessor, a microcontroller, or still another.

Timing controller 96 and valve actuation controller 98 are parts of fueling control unit and are referred to herein generally with regard to structure and functionality of fueling control unit 94 itself. Thus, the various terms are used, at times, interchangeably, and no limitation is thereby intended. Fueling control unit 94 is in control communication with spill valve 70 and solenoid electrical actuator 72 and structured to open spill valve 70 during the ascending ramp phasing of cam lobe 44. Fueling control unit 94 is also structured to close spill valve 70 during the ascending ramp phasing, such that a plunger cavity pressure including a fuel pressure in plunger cavity 54 is increased to oppose a plunger-advancement inertia of actuation train 30. Fueling control unit 94 is further structured to open spill valve 70 to spill the increased plunger cavity pressure to low pressure space 58. Closing spill valve 70 can include energizing solenoid electrical actuator 72 with a control current, and opening spill valve 70 can include deenergizing solenoid electrical actuator 72 by ending the control current. Closing and opening of injection control valve 74 may be performed by analogous energizing and deenergizing of solenoid electrical actuator 76.

Control of fuel pressure in plunger cavity 54 can be used to counteract downward inertia of plunger 60 in a manner that limits gapping separation of components in actuation train 30. Those skilled in the art will be familiar with the concept of ballistic separation in an actuation train. It is contemplated that ballistic, gapping separation between components in actuation train 30 can be limited or eliminated according to the present disclosure. It will be recalled that actuation train 30 defines a plurality of gapping locations. Fueling control unit 94 may be structured to limit gap formation at one or more of the gapping locations based on the increased plunger cavity pressure produced in response to the closing of spill valve 70 as discussed herein. The one or more of the gapping locations may include a gapping location defined between cam follower 32 and pushrod 34. It can thus be envisioned that when pushrod 34 is urged upward, relative to the illustration of FIG. 1, by rotation of cam lobe 44 in the ascending ramp phase plunger 60 will be urged downward. The mass of actuation train 30, and notably the relatively large mass of pushrod 34, could cause gapping separation, at times, between components absent the control of spill valve 70 discussed herein. As noted above, the gapping separation can occur due to the plunger-advancement inertia of the entire actuation train 30 between cam follower 32 and pushrod 34. The present disclosure may also find application to limiting gapping separation between other components of actuation train 30, or between components in different actuation train constructions than that illustrated.

It will be recalled that closing spill valve 70 to oppose plunger-advancement inertia of actuation train 30 occurs during the ascending ramp phasing. It will also be recalled spill valve 70 is opened to spill the increased plunger cavity pressure to low pressure space 58 after the closing of spill valve 70 during the ascending ramp phasing. In some embodiments, fueling control unit 94 is structured to open spill valve 70 to spill the increased plunger cavity pressure after a peak phasing of cam lobe 44. Thus, it can be appreciated that spill valve 70 is closed prior to the peak phasing and opened after the peak phasing. Put differently, fueling control unit 94 may energize solenoid electrical actuator 72 to close spill valve 70 between a first, earlier timing occurring during the ascending ramp phasing of cam lobe 44 and a second timing occurring during the descending ramp phasing of cam lobe 44. As depicted in FIG. 1, a first, earlier timing location on cam lobe 44 is shown at 118 and a second, later timing location is shown at 120. A cam angle between first timing location 118 and second timing location 120 may be less than 60° in some embodiments, in refinements less than 45°, and potentially still smaller. Where cam lobe 44 is rotating counterclockwise it can be seen that cam follower 32 encounters first timing location 118 shortly prior to passing over peak 48 and encounters second timing location 120 shortly after passing over peak 48. Spill valve 70 will be closed approximately at first timing location 118 and opened approximately at second timing location 120 and is thus maintained closed between the first timing occurring the ascending ramp phasing and the second timing occurring during the descending ramp phasing. According to this general strategy a peak force event that would be observed in actuation train 30 approximately where peak 48 is in contact with cam follower 44 if spill valve 70 remained open can be mitigated by increased plunger cavity pressure that opposes the plunger-advancement inertia of actuation train 30.

It should also be appreciated that the controlled closing of spill valve 70 to limit gapping separation in actuation train 30 can occur after a fuel injection event. In one implementation, fueling control unit 94 can be structured to operate fuel injector 28 to perform a main fuel injection at a fuel injection pressure prior to closing spill valve 70 to prevent separation of components in actuation train 30. For instance, spill valve 70 may be closed by fueling control unit 94 by energizing solenoid electrical actuator 72 at a third timing occurring prior to the first timing, during the ascending ramp phasing, to build pressure for injection, and then injection control valve 74 opened and closed to perform a fuel injection. Then spill valve 70 can be opened to spill any excess pressure, and closed again at the first timing. Fueling control unit 94 can thus be understood as structured to close injection control valve 74 prior to the closing of spill valve 70 during the ascending ramp phasing of cam lobe 44. Fueling control unit 94 may also be structured to maintain injection control valve 74 closed until after spill valve 70 is opened at the second timing to spill the increased plunger cavity pressure to low pressure space 58.

Figure 3:
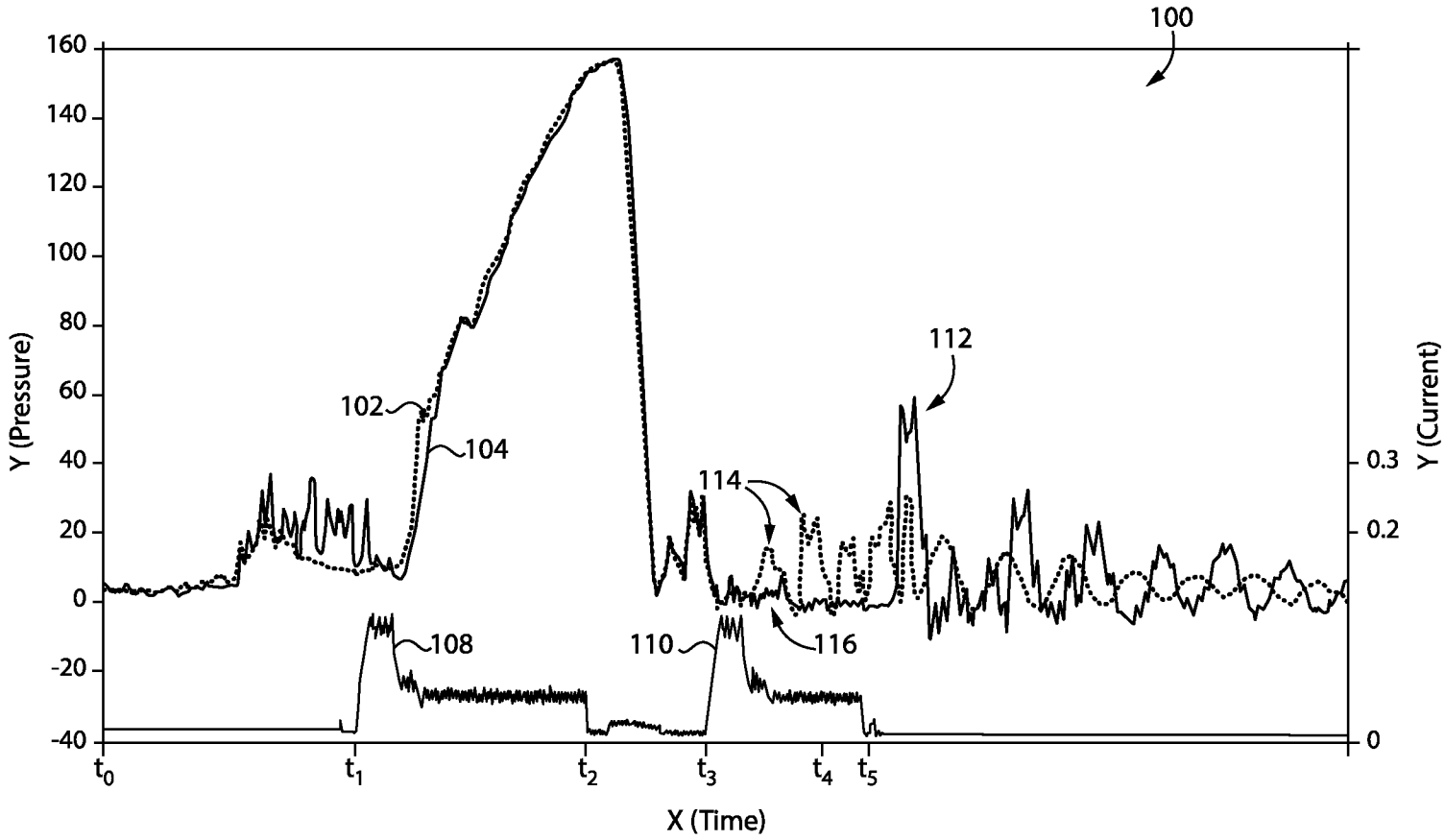
FIG. 3 is a graph of fuel system operating conditions and events, according to one embodiment.

Referring also now to FIG. 3, there is shown a graph 100 illustrating example events, states, and operation of fuel system 20 according to the present disclosure in comparison to a known strategy. In graph 100 a first trace 102 represents fuel pressure that might be observed when operating a fuel system according to the present disclosure. A second trace 104 represents fuel pressure that might be observed in operating a fuel system according to standard practices. A first control current to solenoid electrical actuator 72 is shown at 108. A second control current to solenoid electrical actuator 72 is shown at 110. At a time $t_1$ cam lobe 44 may be in the ascending ramp phasing and fueling control unit 94 energizes solenoid 72. At a time $t_2$ control current 108 ends. At a time $t_3$ control current 110 energizing solenoid 72 is initiated. At a time is control current 110 ends. At approximately a time to cam lobe 44 is at a peak phasing where cam follower 32 is directly upon peak 48.

Trace 104 represents what might be observed where only a first control current is used, and no later control current. As can be seen from trace 104 a force spike occurs at 112. As also shown by way of trace 104 a zero force state is seen at 116. The zero force state can be expected where no force is being transmitted through an actuation train, at least briefly, because gapping separation has occurred. Force spike 112 might be observed where the valve train components once again contact. In some instances, the contact can occur during a descending ramp phasing of the cam lobe, and thus with the cam lobe already trending out of engagement and dropping away from the cam follower, the force spike can be relatively severe. Additional force spikes and separations can be expected in trace 104 following force spike 112. In contrast, in trace 102 only relatively small perturbations to fuel pressure corresponding to small, if any, gapping separation events are seen as illustrated generally at 114. No large force spike is observed in trace 102 due to the improved limitation to gapping separation of components.

It can also be observed from FIG. 3 that in the case of a fuel system operated according to the present disclosure control current 110 closing spill valve 70 at a later timing includes a shorter duration control current. Control current 108 closing spill valve 70 at an earlier timing is a longer duration control current. It should also be appreciated that the relative extent to which plunger cavity pressure is increased can vary between the two instances where spill valve 70 is closed. Closing spill valve 70 using longer duration control current 108 can result in a relatively greater increase in plunger cavity pressure, to an injection pressure of a greater magnitude. Closing spill valve 70 using control current 110 can produce an increase in plunger cavity pressure to a lesser magnitude. A dwell time from $t_2$ to $t_3$ between longer duration control current 108 and shorter duration control current 110 may be less than durations of longer duration control current 108 and shorter duration control current 110. A varied angle of cam lobe 44 between first timing location 118 and second timing location 120 also influences the relative extent to which plunger cavity pressure is varied by the controlled closing of spill valve 70.

INDUSTRIAL APPLICABILITY

Figure 4:
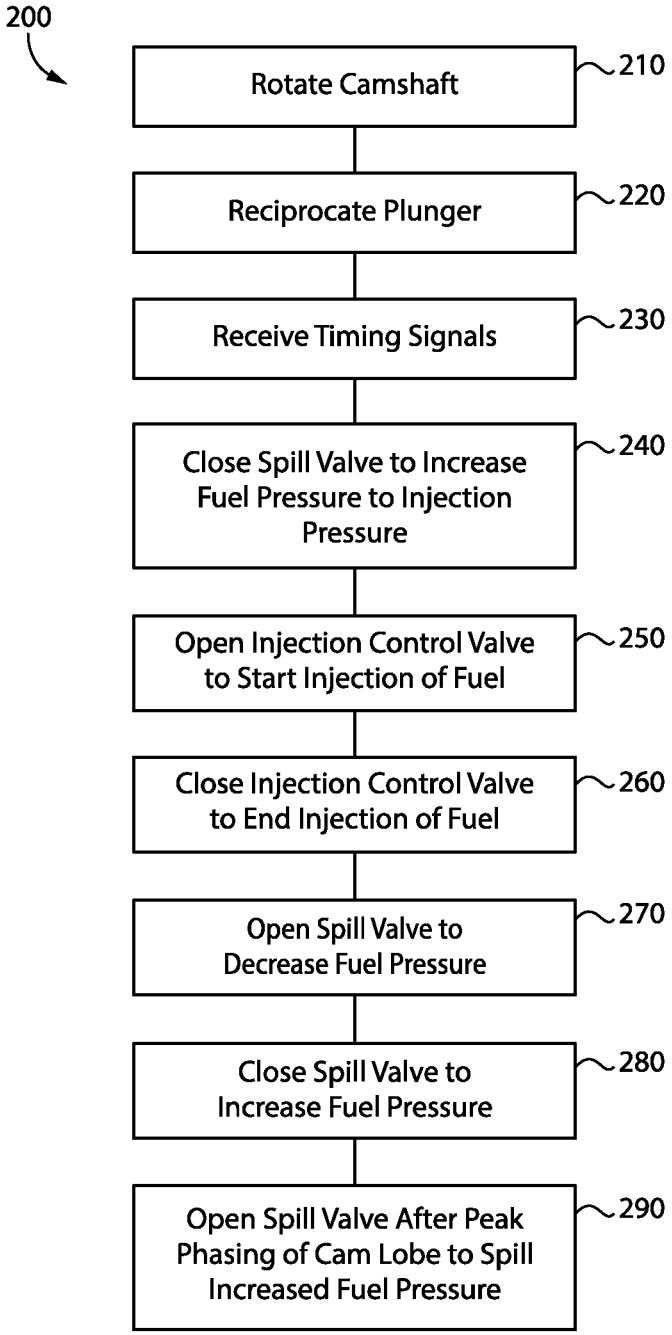
FIG. 4 is a flowchart illustrating example methodology and logic flow, according to one embodiment.

Referring to the drawings generally, but also now to FIG. 4, there is shown a flowchart 200 illustrating example methodology and logic flow, according to the present disclosure. At a block 210 camshaft 42 is rotated to rotate cam lobe 44 in contact with cam follower 32 and thus reciprocate pushrod 34. Pushrod 34 is coupled to pivotable rocker arm 36 and thus causes rocker arm 36 to pivot, advancing and retracting plunger 60 in fuel injector 28 to exchange fuel between plunger cavity 54 in fuel injector 28 and low pressure space 58 so long as spill valve 70 is open. Plunger reciprocation 60 is shown at a block 220.

From block 220 the logic can advance, or execute in parallel, a block 230 to receive timing signals. Receiving timing signals means that fueling control unit 94 is monitoring engine timing indicative of a cam phasing of camshaft 42. From block 230 flowchart 200 advances to a block 240 to close spill valve 70 to block plunger cavity 54 from low pressure space 58. The closing of spill valve 70 at block 240 can be understood as closing spill valve 70 to enable increasing fuel pressure in fuel injector 28 to an injection pressure, and will typically occur during an ascending ramp phasing of cam lobe 44 but could instead occur at an earlier timing. From block 240 flowchart 200 advances to a block 250 to open injection control valve 74 to start an injection of fuel from fuel injector 28 at the injection pressure.

From block 250 flowchart 200 advances to a block 260 to close injection control valve 74 to end the injection of fuel. Closing injection control valve 74 as in block 260 also occurs during the ascending ramp phasing of cam lobe 44. From block 260 flowchart 200 advances to a block 270 to open spill valve 70 to decrease/spill fuel pressure. From block 270 flowchart 200 advances to a block 280 to close spill valve 70 to block plunger cavity 54 from low pressure space 58. Closing spill valve 70 as in block 270 also occurs during the ascending ramp phasing of cam lobe 44 and produces an increased plunger cavity pressure that opposes plunger-advancement inertia of actuation train 30. As discussed herein, the opposition to plunger-advancement inertia limits gapping separation in actuation train 30. From block 280 flowchart 200 advances to a block 290 to open spill valve 70 after the peak phasing of cam lobe 44 to spill all of the increased plunger cavity fuel pressure to low pressure space 58. Following the operations illustrated in flowchart 200 camshaft 42 will continue to rotate, and spill valve 70 can then be once again closed and injection control valve 74 suitably operated to perform another fuel injection in another engine cycle.

The present description is for illustrative purposes only, and should not be construed to narrow the breadth of the present disclosure in any way. Thus, those skilled in the art will appreciate that various modifications might be made to the presently disclosed embodiments without departing from the full and fair scope and spirit of the present disclosure. Other aspects, features and advantages will be apparent upon an examination of the attached drawings and appended claims. As used herein, the articles "a" and "an" are intended to include one or more items, and may be used interchangeably with "one or more." Where only one item is intended, the term "one" or similar language is used. Also, as used herein, the terms "has," "have," "having," or the like are intended to be open-ended terms. Further, the phrase "based on" is intended to mean "based, at least in part, on" unless explicitly stated otherwise.

What is claimed is:

1. A fuel system for an internal combustion engine comprising:

an actuation train including a cam follower, a pushrod, a rocker arm, a plunger tappet, and a camshaft having a cam lobe forming an ascending ramp, a peak, and a descending ramp, and rotatable in contact with the cam follower according to an ascending ramp phasing, a peak phasing, and a descending ramp phasing;

a fuel injector having formed therein a plunger cavity and a plurality of nozzle outlets, and defining a low pressure space, and the fuel injector including a plunger coupled to the plunger tappet and movable within the plunger cavity, a nozzle check, and an electrically actuated spill valve adjustable between a closed state where the electrically actuated spill valve blocks the plunger cavity from the low pressure space, and an open state; and a fueling control unit in control communication with the electrically actuated spill valve and structured to:

open the electrically actuated spill valve during the ascending ramp phasing of the cam lobe;

close the electrically actuated spill valve during the ascending ramp phasing, such that a plunger cavity pressure is increased to oppose a plunger-advancement inertia of the actuation train; and open the electrically actuated spill valve to spill the increased plunger cavity pressure to the low pressure space.

2. The fuel system of claim 1 wherein the fueling control unit is further structured to open the electrically actuated spill valve to spill the increased plunger cavity pressure after a peak phasing of the cam lobe.

3. The fuel system of claim 2 wherein the fueling control unit is further structured to open the electrically actuated spill valve to spill the increased plunger cavity pressure during the descending ramp phasing of the cam lobe.

4. The fuel system of claim 1 wherein the actuation train defines a plurality of gapping locations, and the fueling control unit is further structured to limit gap formation at one or more of the gapping locations based on the increased plunger cavity pressure.

5. The fuel system of claim 4 wherein the one or more of the gapping locations includes a gapping location of the cam follower and the pushrod.

6. The fuel system of claim 1 wherein the fuel injector further includes an electrically actuated injection control valve, and the fueling control unit is further structured to close the electrically actuated injection control valve to end an injection of fuel, prior to the closing of the electrically actuated spill valve during the ascending ramp phasing of the cam lobe.

7. The fuel system of claim 6 wherein the fueling control unit is further structured to maintain the electrically actuated injection control valve closed until after the spilling of the increased plunger cavity pressure to the low pressure space.

8. The fuel system of claim 1 wherein:

the closing of the electrically actuated spill valve during the ascending ramp phasing occurs at a later timing and such that the plunger cavity pressure is increased to a pressure of a lesser magnitude; and the fueling control unit is further structured to close the electrically actuated spill valve at an earlier timing during the ascending ramp phasing and such that the plunger cavity is increased to an injection pressure of a greater magnitude.

9. The fuel system of claim 8 wherein the fueling control unit is further structured to close the electrically actuated spill valve at the later timing using a shorter duration control current, and to close the electrically actuated spill valve at the earlier timing using a longer duration control current.

10. A method of operating a fuel system for an internal combustion engine comprising:

rotating a cam lobe in contact with a cam follower to reciprocate a pushrod coupled to a rocker arm in an actuation train for a fuel injector in the fuel system;

advancing and retracting a plunger in the fuel injector coupled to the rocker arm to exchange a fuel between a plunger cavity in the fuel injector and a low pressure space;

closing a spill valve at an earlier timing to block the plunger cavity from the low pressure space, during an ascending ramp phasing of the cam lobe, to increase a plunger cavity pressure in the fuel injector to an injection pressure;

injecting a fuel from the fuel injector at the injection pressure;

closing the spill valve at a later timing to block the plunger cavity from the low pressure space, during the ascending ramp phasing of the cam lobe;

opposing a plunger-advancement inertia of the actuation train via an increased plunger cavity pressure produced in response to the closing of the spill valve at the later timing;

limiting gapping in the actuation train based on the opposing the plunger-advancement inertia of the actuation train; and opening the spill valve to spill the increased plunger cavity pressure to the low pressure space.

11. The method of claim 10 wherein the limiting gapping includes limiting gapping between the cam follower and the pushrod.

12. The method of claim 10 further comprising maintaining a nozzle check in the fuel injector closed after the injecting a fuel and until after a peak phasing of the cam lobe.

13. The method of claim 10 wherein the opening the spill valve to spill the increased plunger cavity pressure includes opening the spill valve during a descending ramp phasing of the cam lobe.

14. The method of claim 10 wherein the closing the spill valve at an earlier timing includes closing the spill valve using a longer duration control current to a spill valve electrical actuator, and the closing of the spill valve at a later timing includes closing the spill valve using a shorter duration control current to the spill valve electrical actuator.

15. The method of claim 14 wherein a dwell time between the longer duration control current and the shorter duration control current is less than durations of the longer duration control current and the shorter duration control current.

16. The method of claim 14 wherein a cam angle defined between the earlier timing and the later timing is less than 60°.

17. The method of claim 10 wherein the opposing the plunger-advancement inertia includes opposing the plunger-advancement inertia via an increased fuel pressure that is less than the injection pressure.

18. A control system for an engine fuel system including a fuel injector having a plunger within a plunger cavity, and an actuation train for the plunger having a cam follower, a pushrod, a rocker arm, a plunger tappet, and a camshaft having a cam lobe forming an ascending ramp, a peak, and a descending ramp, and rotatable in contact with the cam follower according to an ascending ramp phasing, a peak phasing, and a descending ramp phasing, the control system comprising:

a fueling control unit including a timing controller structured to receive timing signals from a timing sensor indicative of the cam phasing of the cam lobe, and a valve actuation controller structured to:

deenergize a solenoid actuator of a spill valve in the fuel injector to open the spill valve during the ascending ramp phasing;

deenergize a solenoid actuator of an injection control valve in the fuel injector to close the injection control valve during the ascending ramp phasing to end an injection of fuel from the fuel injector;

energize the solenoid actuator of the spill valve to close the spill valve between a first timing occurring during the ascending ramp phasing and a second timing occurring during the descending ramp phasing; and limit ballistic separation in the actuation train based on an increase to a plunger cavity pressure produced in response to the closing of the spill valve between the first timing and the second timing.

19. The control system of claim 18 wherein the valve actuation controller is further structured to energize the solenoid actuator of the spill valve to close the spill valve between the first timing and the second timing using a shorter duration control current, and to energize the solenoid actuator of the spill valve to close the spill valve at a third timing occurring before the first timing and using a longer duration control current.

20. The control system of claim 19 wherein the pressure in the plunger cavity is increased to a pressure of a lesser magnitude based on the closing of the spill valve between the first timing and the second timing, and increased to an injection pressure of a greater magnitude based on the closing of the spill valve at the third timing.

* * * * *